US005530631A

United States Patent [19]

Smith et al.

[11] Patent Number: 5,530,631

[45] Date of Patent: Jun. 25, 1996

[54] APPARATUS FOR ATTACHING A LIGHT HOUSING TO A MASK BODY OR OTHER STRUCTURE

[76] Inventors: Tristan P. Smith, 1239 Green Garden Dr. #4, El Cajon, Calif. 92021; Alex Bleyaert, 245 Van Vorst, Apt. 1A, Jersey City, N.J. 07302; Tom Y. Smith, III, 669 Sussex Cir., Vernon Hills, Ill. 60061

[21] Appl. No.: 267,489

[22] Filed: Jun. 29, 1994

[51] Int. Cl.[6] ..... F21L 15/14

[52] U.S. Cl. ..... 362/105; 362/253; 362/396; 362/418; 248/229.1; 16/337

[58] Field of Search ..... 362/105, 98, 253, 362/396, 418; 351/41, 44, 47; 248/231.4, 228; 16/337, 286, 307, 237

[56] References Cited

U.S. PATENT DOCUMENTS

| | | | |
|---|---|---|---|
| 1,900,906 | 3/1933 | Brown . | |
| 2,320,209 | 5/1943 | Bahr | 248/228 |
| 2,420,362 | 5/1947 | Ekleberry . | |
| 2,904,670 | 9/1959 | Calmes . | |
| 3,087,049 | 4/1963 | Schecter . | |
| 3,350,552 | 10/1967 | Lawrence | 362/396 |
| 3,500,037 | 3/1970 | Starck, II . | |
| 4,638,410 | 1/1987 | Barker . | |
| 4,781,422 | 11/1988 | Kimble | 16/337 |
| 5,016,151 | 5/1991 | Mula . | |
| 5,180,220 | 1/1993 | Van Kalsbeek | 362/396 |
| 5,224,772 | 7/1993 | Fustos | 362/105 |

OTHER PUBLICATIONS

Four photographs, photos 1–4, of a conventional lock pin apparatus.

*Investigation of Permissible Electric Mine Lamps,* Bulletin 441, United States Department of the Interior (1930–1940).

*Primary Examiner*—James C. Yeung

*Attorney, Agent, or Firm*—Speckman, Pauley & Fejer

[57] ABSTRACT

An apparatus for attaching a light housing to a conventional mask body or other suitable structure, in which a stationary clamp bracket and a moveable clamp bracket are used to fix a relative position of a clamp body with respect to the mask body or other structure. An externally threaded clamp adjustment screw is rotatably mounted with respect to the clamp body and is used to adjustably move and lock the moveable clamp bracket with respect to the stationary clamp bracket. A track receptacle, which is fixed with respect to the clamp body, has a track bore. A track rod which is fixed with respect to the light housing, is rotatably mountable within the track bore. A lock-bearing rod is slidably mounted with a longitudinal track rod bore of the track rod. A return spring mounted within the longitudinal track rod bore, a compression spring surrounding the lock-bearing rod, and a lock-bearing positioned within a transverse lock-bearing bore of the track rod allow the light housing to be rotatably adjusted and locked with respect to the clamp body.

20 Claims, 6 Drawing Sheets

APPARATUS FOR ATTACHING A LIGHT HOUSING TO A MASK BODY OR OTHER STRUCTURE

BACKGROUND OF THE INVENTION

1. Field of the Invention

This invention relates to an apparatus for attaching one structure, such as a light housing, to another structure, such as a mask body. The one structure may be rotatably adjusted and locked with respect to the other structure.

2. Description of Prior Art

Barker, U.S. Pat. No. 4,638,410 teaches a diving helmet having a rotatable lamp housing. The lamp housing is rotated to change the direction of the light with respect to the diving helmet. An O-ring is positioned between the diving helmet and the lamp housing to prevent water leakage from the exterior into a cavity of the helmet which contains electrical components. The lamp assemblies are independently mounted within the helmet and are activated by individual toggle switches.

Ekleberry, U.S. Pat. No. 2,420,362 discloses a diver's light which is mounted to a diving helmet. The light housing has a socket-shaped interior portion within which a ball-shaped portion is mounted. O-rings are used to provide a seal between the ball-shaped portion and the lamp housing.

Mula, U.S. Pat. No. 5,016,151 teaches an underwater light source having a water-tight housing for accommodating operation of a sealed beam arc-lamp.

Schecter, U.S. Pat. No. 3,087,049 discloses a head lamp having an adjustable switch. A casing can be universally adjusted with respect to a forehead piece. A knob can be used to select an angle of tilt at which the light source is energized. A bulbous portion of a mercury switch device is used to energize the light source at the selected angle of tilt.

Starck II, U.S. Pat. No. 3,500,037 discloses an underwater hand-held light. The lamp is rotatably and detachably mounted with respect to the frame of an electrical circuit box.

Calmes, U.S. Pat. No. 2,904,670 teaches illuminating spectacles having small electric lamps energized by independent remote sources of current, such as a battery which can be carried in a pocket of a user's garment.

Brown, U.S. Pat. No. 1,900,906 discloses a portable electric light. A housing of a lamp is rotatably mounted with respect to a bracket by using threaded posts and nuts.

*Investigation of Permissible Electric Mine Lamps,* Bulletin 441, United States Department of the Interior (1930–1940), teaches various brackets for mounting a light with respect to a helmet.

Although many devices for providing illumination have been disclosed by the prior art, providing illumination in environments such as diving, where conventional diving masks are generally used, poses additional concerns because conventional masks cannot be readily adapted to accommodate illumination devices. An illumination helmet is a cumbersome alternative to a compact light/diving mask unit.

SUMMARY OF THE INVENTION

It is one object of this invention to provide an apparatus for attaching a light housing to a conventional mask body or other structure, without modification or alteration to the conventional mask bodies.

It is another object of this invention to provide an apparatus for attaching a light housing to a mask body or other structure, so that the light housing can be rotatably adjusted to a desired angle and locked into a fixed position while mounted on the mask body or other structure.

It is yet another object of this invention to provide an apparatus for attaching a light housing to a mask body or other structure, wherein the light housing can be quickly and easily removed from the mask body or other structure, particularly without the use of tools.

The above-mentioned and other objects of this invention are achieved with an apparatus for attaching a light housing to a mask body or other structure, according to one preferred embodiment of this invention, wherein a stationary clamp bracket is fixed with respect to a clamp body and a moveable clamp bracket can be adjustably moved and then locked with respect to the stationary clamp bracket. An externally threaded clamp adjustment screw is preferably used to adjustably move and lock the moveable clamp bracket with respect to the stationary clamp bracket. The externally threaded clamp adjustment screw is rotatably mounted with respect to the clamp body and is engagable within an internally threaded bore of the moveable clamp bracket. In one preferred embodiment according to this invention, the internally threaded bore of the moveable clamp bracket is a through bore. It is apparent that depending upon desired dimensions, the internally threaded bore can be a closed bore.

In another preferred embodiment according to this invention, the stationary clamp bracket has a support bore for a bearing end of the adjustment screw which is rotatably positioned within the support bore. A support bracket, which is fixed with respect to the clamp body, provides adjustable movement and locking capabilities of the moveable clamp bracket with respect to the stationary clamp bracket. In one preferred embodiment according to this invention, the adjustment screw is rotatably supported within the support bracket. The moveable clamp bracket preferably has a support flange which is slidably engagable within a guide channel of the stationary clamp bracket.

In another preferred embodiment according to this invention, a track receptacle is fixed with respect to the clamp body. A track rod, which is fixed with respect to the light housing is rotatably mountable within a track bore of the track receptacle. A lock-bearing rod, which is slidably mounted within a bore of the track rod, is used to adjustably rotate and lock the track rod with respect to the track receptacle.

In one preferred embodiment according to this invention, the track rod is cylindrical. A return spring positioned within the longitudinal track rod bore urges the lock-bearing rod into a normally locked position with respect to the track rod. In one preferred embodiment according to this invention, the return spring is positioned within the bore of the track rod and biases the lock-bearing rod with respect to the track rod. One end of the return spring is preferably fixed with respect to the track rod, and an opposite end of the return spring is preferably fixed with respect to the lock-bearing rod.

In another preferred embodiment according to this invention, a lock-bearing and a transverse lock-bearing bore in the track rod are used to adjustably rotate and lock the track rod within the track bore. The lock-bearing is housed within the transverse lock-bearing bore, particularly at a position where the lock-bearing abuts the lock-bearing rod. The lock-bearing can be moved into a position which interferes with a lock-bearing contact surface of the track receptacle.

In one preferred embodiment according to this invention, the lock-bearing rod has a locking rod portion and a tapered rod portion adjacent to the locking rod portion. The tapered rod portion converges along the locking rod in a direction away from the locking rod portion. A stop or shoulder surface is formed adjacent the tapered rod portion and is used to limit movement of the lock-bearing. One end of the track rod is preferably attached to the light housing and an opposite end of the lock-bearing rod preferably extends beyond the track bore of the track receptacle.

In another preferred embodiment according to this invention, a compression spring, which is preferably a coiled spring surrounding both the track rod and the lock-bearing rod, is used to urge the track rod into a rotationally locked position with respect to the track receptacle. One end of the compression spring is preferably fixed with respect to the track receptacle and an opposite end of the compression spring is preferably fixed with respect to the track rod. In one preferred embodiment according to this invention, the compression spring abuts a beveled washer which is thereby urged against a beveled contact surface of the track receptacle.

The light housing preferably has a plurality of light source compartments and a light source is positioned or mounted within each of the light source compartments. Preferably, each light source compartment is independently sealed.

In one preferred embodiment according to this invention, a clamp body is attached to a conventional mask or other structure by positioning stationary and moveable jaws, formed by the stationary and moveable clamp brackets, respectively, adjacent a protruding frame of a conventional mask or other structure. The externally threaded clamp adjustment screw is rotated or adjusted to engage the stationary and moveable jaws into a clamped position with respect to the protruding frame. Although the clamp body is preferably clamped to the mask body or other structure, it is apparent that in other embodiments according to this invention the clamp body and the mask body or other structure may be formed as an integral piece. The track rod, which is attached to the light housing, can then be inserted into the track bore of the track receptacle which is attached to the clamp body. By engaging the release button end and thereby allowing movement of the track rod into the track bore, the compression spring is compressed between the light housing and the track receptacle. By disengaging the release button end, the locking rod portion of the lock-bearing rod abuts the lock-bearing and causes the lock-bearing to protrude from the transverse lock-bearing bore, beyond an external surface of the track rod. The compression spring forces the protruding portion of the lock-bearing against a contact surface of the track receptacle, which allows the track rod and the attached light housing to be angularly or rotatably adjusted with respect to the track receptacle and the mask body or other structure.

The light housing may be removed from the mask body or other structure without removing the clamp body by pressing the release button end of the lock-bearing rod which extends through the longitudinal track rod bore beyond the light housing. Pressing the release button end of the lock-bearing rod shifts the tapered rod portion of the lock-bearing rod under the lock-bearing, allowing the lock-bearing bearing to recede into the lock-bearing bore, which allows the track rod to be removed from the track bore. Although in one preferred embodiment according to this invention, locking and releasing the lamp housing to and from the track receptacle is accomplished with the lock-bearing and the lock-bearing rod, it is apparent that other embodiments according to this invention may utilize other suitable elements for accomplishing the same result. Furthermore, it is apparent that in other embodiments according to this invention, the lamp housing is permanently fixed with respect to the track receptacle and attached clamp body.

BRIEF DESCRIPTION OF THE DRAWINGS

The above-mentioned and other features of this invention will become more apparent when viewed in conjunction with the drawings wherein.

DESCRIPTION OF PREFERRED EMBODIMENTS

Figure 1:
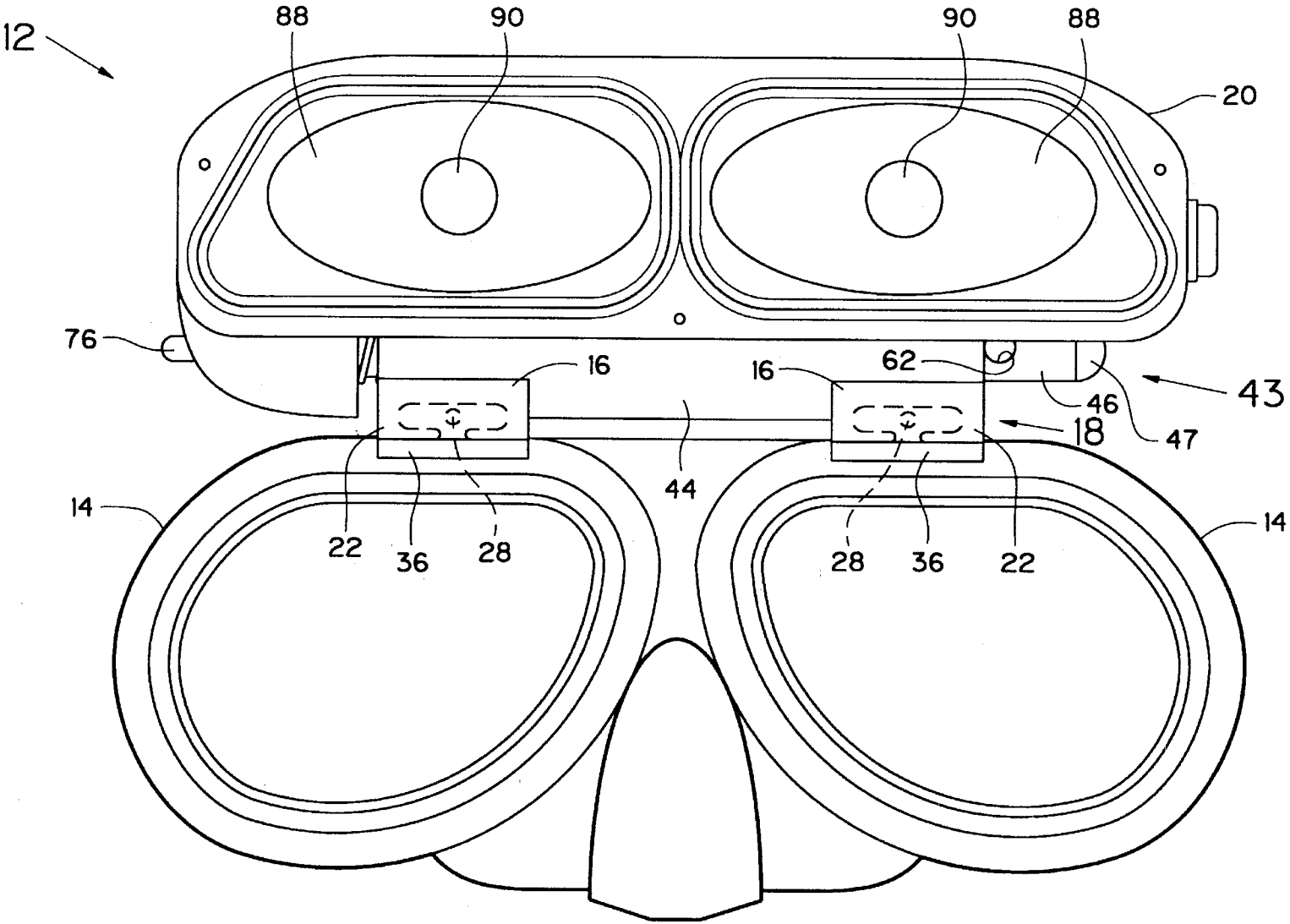
FIG. 1 is a front view of an apparatus for attaching a light housing to a mask body or other structure, showing the light housing attached to the mask body or other structure, according to one preferred embodiment of this invention.

FIG. 1 illustrates an apparatus for attaching one structural body, such as light means 12, to another structural body, such as mask body 14, according to one preferred embodiment of this invention. Clamping means 18 preferably fix a relative position of clamp body 16 with respect to mask body 14. It is apparent that clamp body 16 can be adjustably mounted with respect to mask body 14, in another preferred embodiment according to this invention.

Pivot means 43 allow light housing 20 to be rotatably adjusted to a desired angular position and then locked with respect to clamp body 16. As shown in the preferred embodiment of FIGS. 2A–2D, clamping means 18 comprise stationary clamp bracket 22, moveable clamp bracket 24, and clamp adjustment means 25 for adjustably moving and then locking moveable clamp bracket 24 with respect to stationary clamp bracket 22. Stationary clamp bracket 22 is preferably fixed with respect to clamp body 16 but it is apparent that stationary clamp bracket 22 can also be adjustably mounted with respect to clamp body 16. Clamping means 18 enable clamp body 16 and light means 12 to be attached to many conventional helmets, masks, such as a diving mask, or other suitable structure.

Figures 2A, 2B, 2C, 2D:
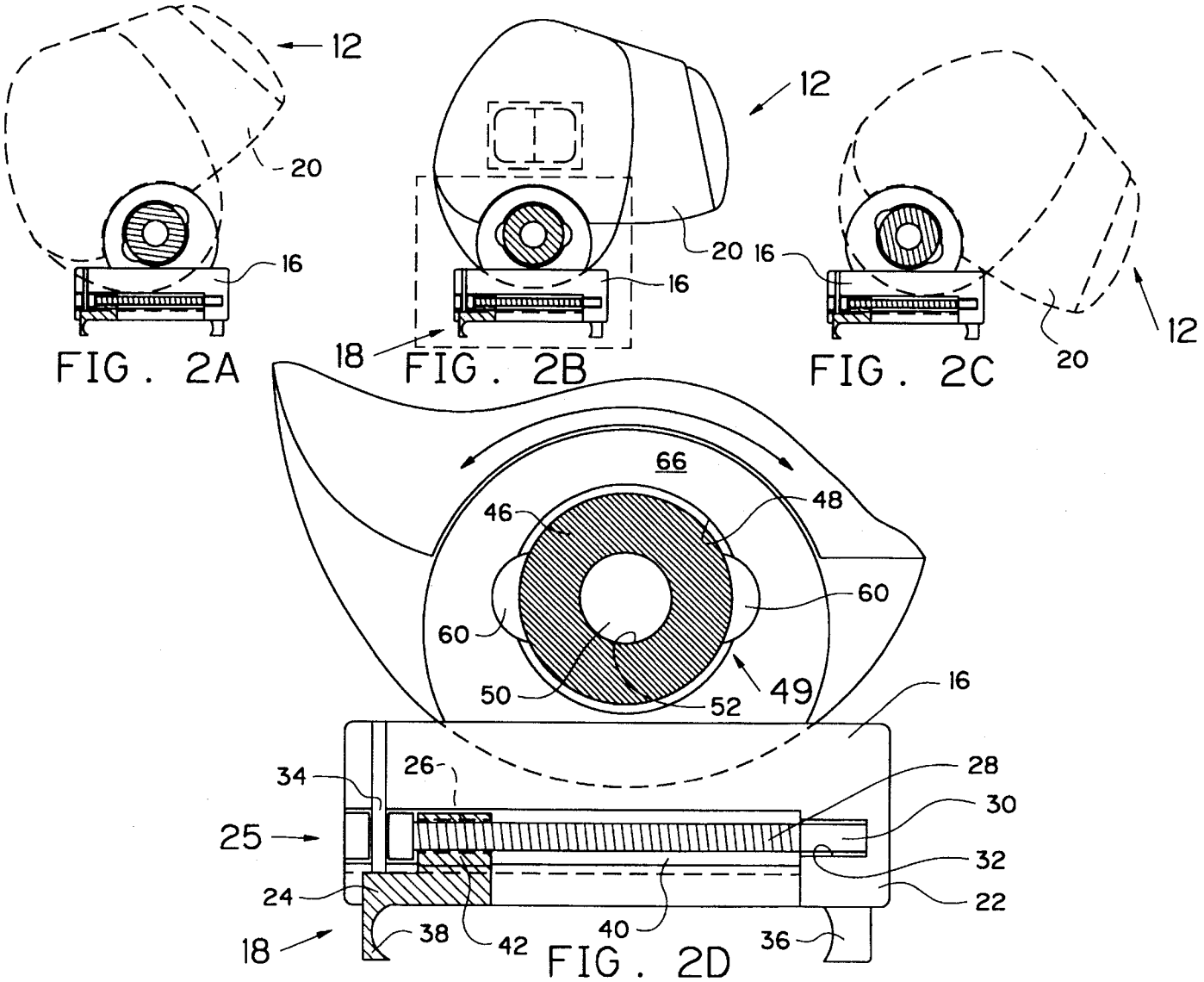
FIG. 2A is a side view of an apparatus for attaching a light housing to a mask body or other structure, showing the light housing pivoted into an upward position, according to one preferred embodiment of this invention.
FIG. 2B is a side view of the apparatus for attaching a light housing to a mask body or other structure, as shown in FIG. 2A but with the light housing pivoted into a forward position.
FIG. 2C is a side view of the apparatus for attaching a light housing to a mask body or other structure, as shown in FIG. 2A but with the light housing pivoted into a downward position.
FIG. 2D is an enlarged side view of the apparatus for attaching a light housing to a mask body or other structure, as shown within the box formed by the dashed lines of FIG. 2B.
Figure 6:
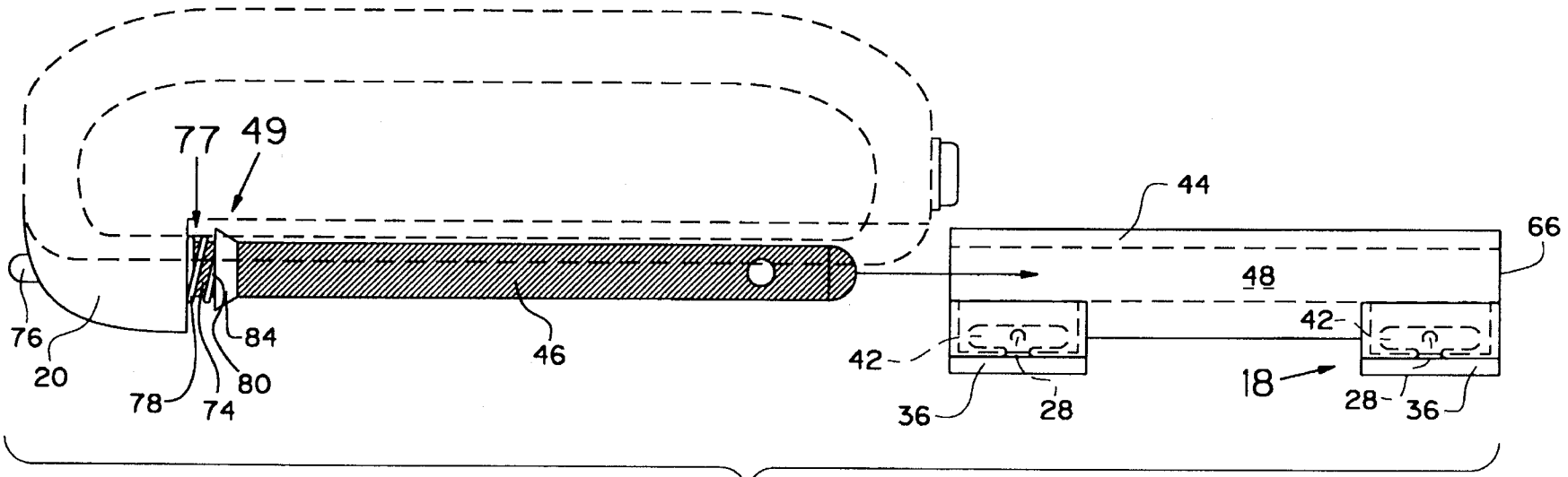
FIG. 6 is an exploded front partial cross-sectional view of the apparatus for attaching a light housing to a mask body or other structure, as shown in FIG. 5.
Figure 7A:
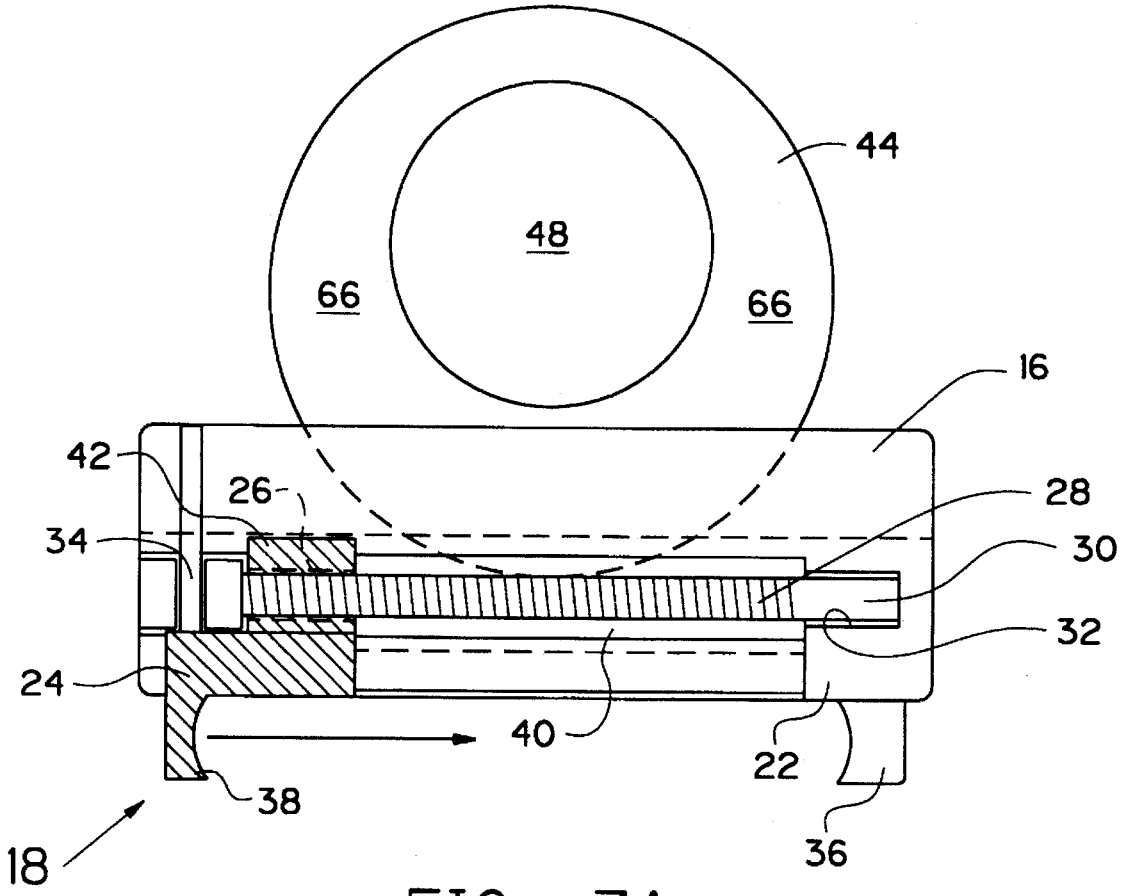
FIG. 7A is a side partial cross-sectional view of the apparatus for attaching a light housing to a mask body or other structure, according to still another preferred embodiment of this invention.
Figure 7B:
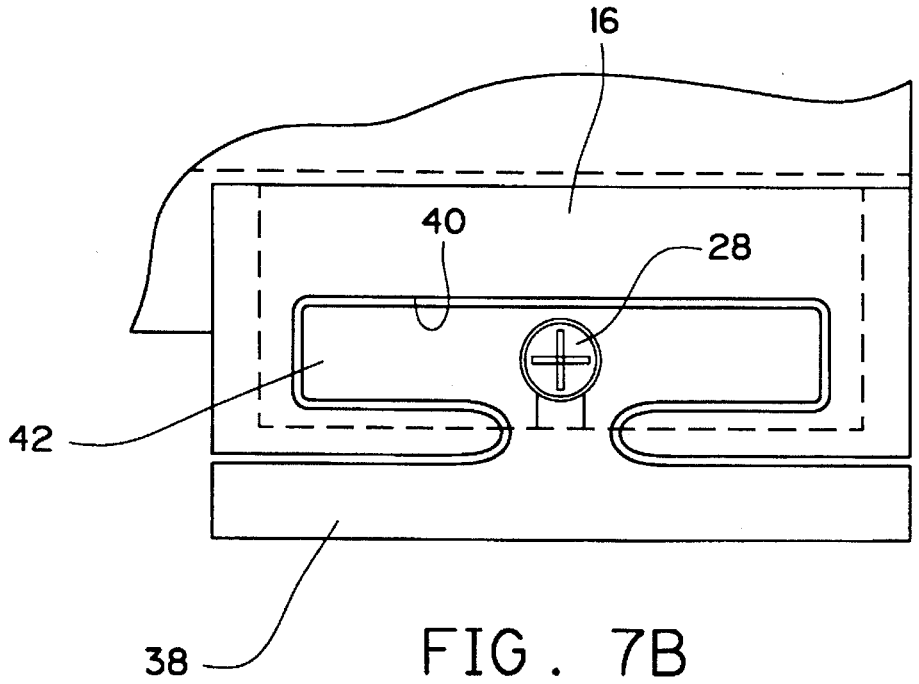
FIG. 7B is an enlarged front view of a portion of the apparatus shown in FIG. 7A, showing a moveable clamp bracket.

In one preferred embodiment according to this invention, as clearly shown in FIG. 2D, moveable clamp bracket 24 has internally threaded bore 26. Externally threaded clamp adjustment screw 28 is rotatably mounted with respect to clamp body 16. Adjustment screw 28 is matingly engagable within internally threaded bore 26. Moveable clamp bracket 24 can be moved from left to right, as shown in FIG. 2D, by rotating adjustment screw 28 with respect to clamp body 16. As shown in FIGS. 2D and 7A, internally threaded bore 26 of movable clamp bracket 24 is a through bore but it is apparent that the same result of this invention could be achieved with a blind bore. Adjustment screw 28 preferably has bearing end 30 and stationary clamp bracket. 22 preferably has support bore 32. Bearing end 30 can be supported within support bore 32. As shown in FIGS. 2D and 7A, support bracket 34 is fixed with respect to clamp body 16 and adjustment screw 28 is rotatably supported within an internally threaded through bore of support bracket 34. As shown in FIGS. 2D and 7A, stationary clamp bracket 22 forms stationary jaw 36 and moveable clamp bracket 24 forms moveable jaw 38. As shown in FIGS. 2D, 6 and 7A support flange 42 of moveable clamp bracket 24 is slidably engagable within guide channel 40 of clamp body 16.

In one preferred embodiment of this invention, pivot means 43 comprise track receptacle 44 being fixed with respect to clamp body 16. Track rod 46 is preferably fixed with respect to light housing 20. Track rod 46 is rotatably mountable within track bore 48 of track receptacle 44. Pivot means 43 may further comprise angular adjustment means 49 for adjustably rotating and then locking track rod 46 within track bore 48.

Figure 3:
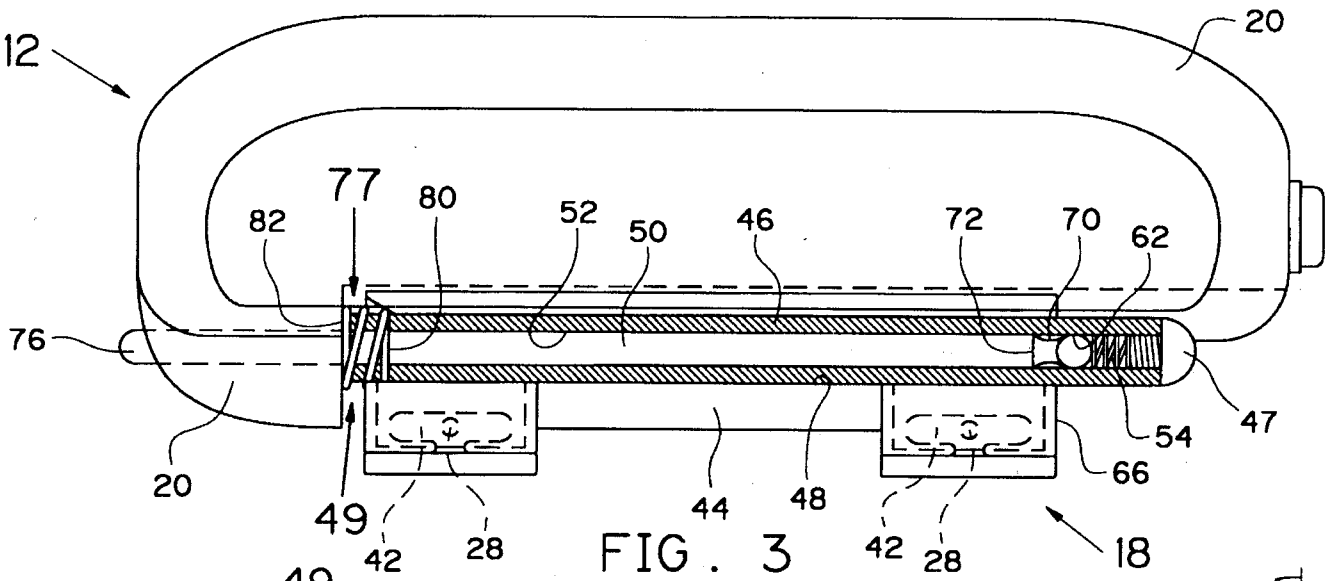
FIG. 3 is a front partial cross-sectional view of an apparatus for attaching a light housing to a mask body or other structure, according to one preferred embodiment of this invention.
Figure 4:
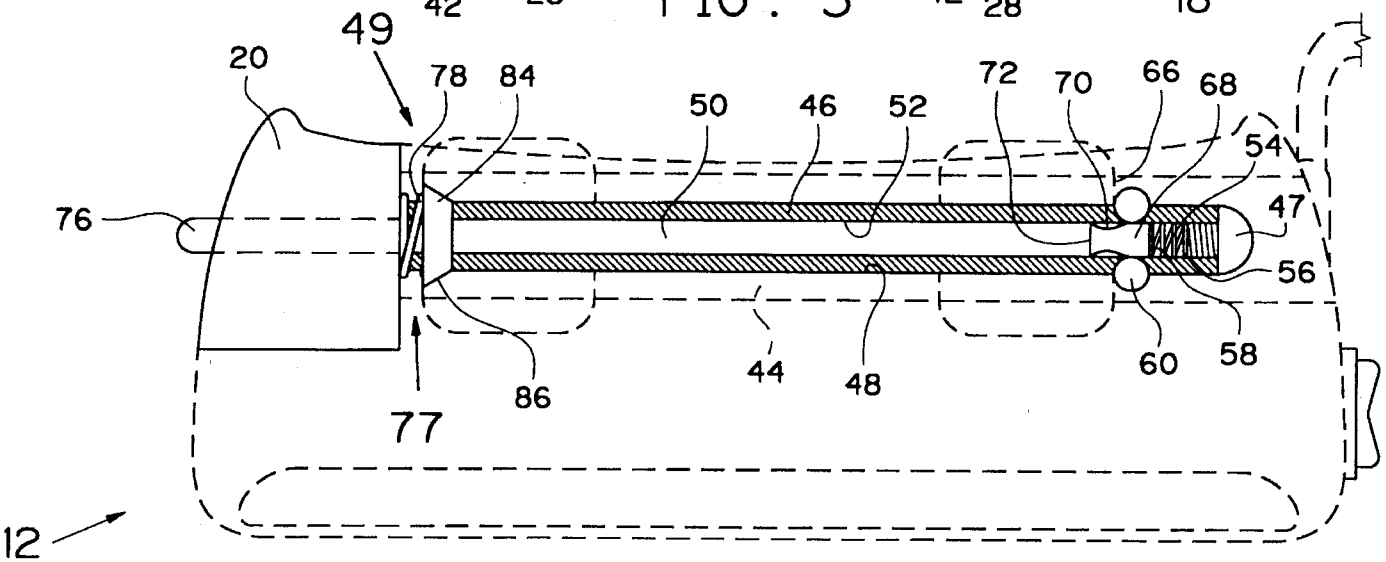
FIG. 4 is a top partial cross-sectional view of the apparatus for attaching a light housing to a mask body or other structure, as shown in FIG. 3.

As shown in FIGS. 3 and 4, angular adjustment means 49 comprise track rod 46 having longitudinal track rod bore 52. As shown in FIGS. 2D, 3 and 4, lock-bearing rod 50 is slidably mounted within longitudinal track rod bore 52. Angular adjustment means 49 may further comprise rod bias means for urging lock-bearing rod 50 into a locked position. As shown in FIGS. 3 and 4, the rod bias means comprise return spring 54 positioned within longitudinal track rod bore 52 of track rod 46, and it is apparent that lock-bearing rod 50 is positionable within track rod 46 which is positionable within track bore 48. In this manner, track rod end. 56 of return spring 54 is fixed with respect to or abuts end cap 47, which is threadedly engaged with track rod 46, and lock rod end 58 of return spring 54 is fixed with respect to or abuts lock bearing rod 50.

Figure 8A:
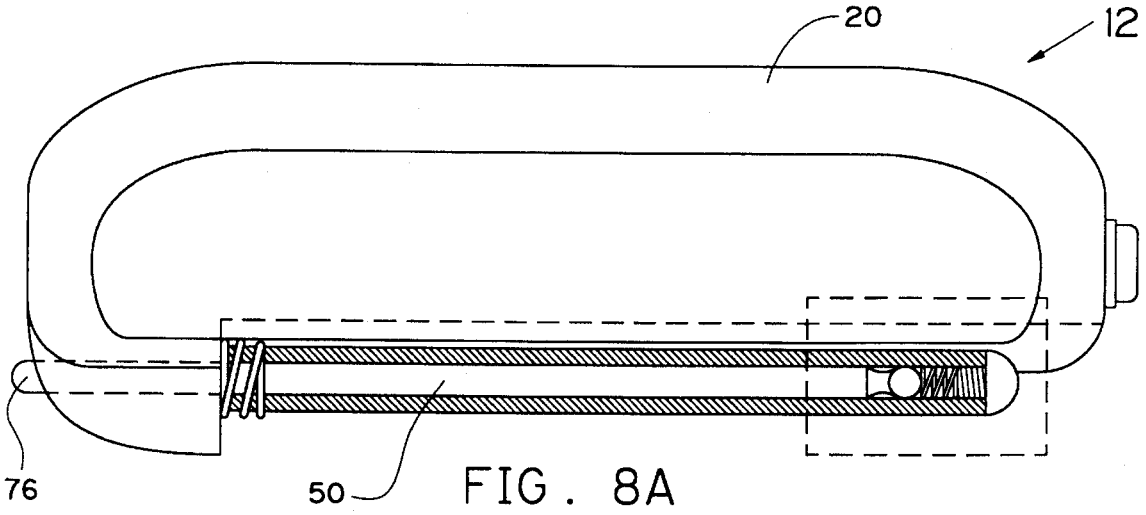
FIG. 8A is a front partial cross-sectional view of an apparatus for attaching a light housing to a mask body or other structure, according to another preferred embodiment of this invention.
Figure 8B:
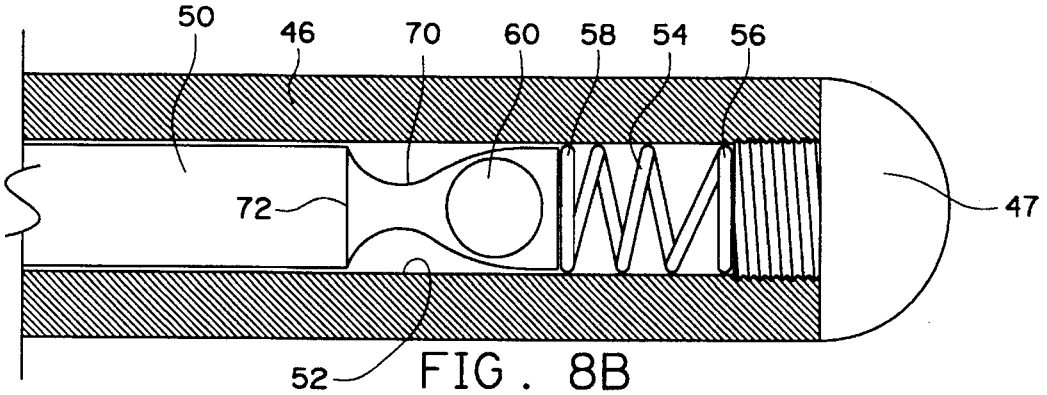
FIG. 8B is an enlarged front partial cross-sectional view of the portion of the apparatus shown in the dashed line box in FIG. 8A.
Figure 8C:
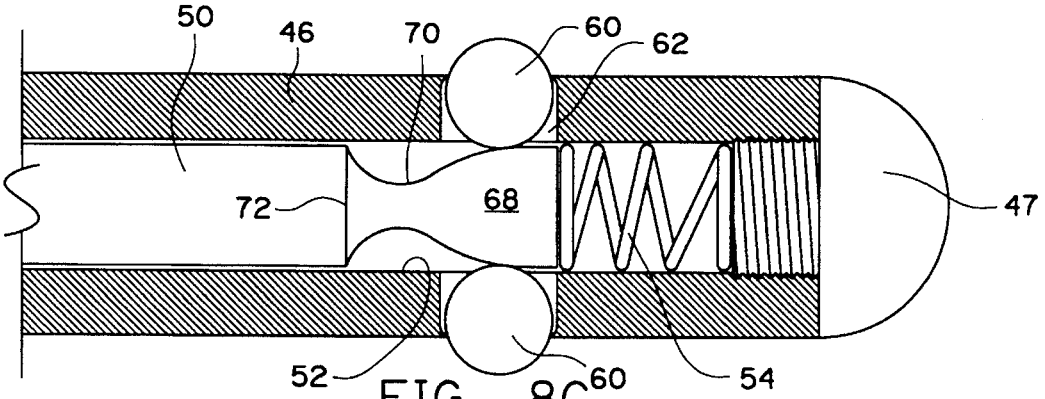
FIGS. 8C and 8D are each an enlarged top partial cross-sectional view of a lock-bearing rod as shown in FIG. 8B, in a locked and an unlocked position, respectively.
Figure 8D:
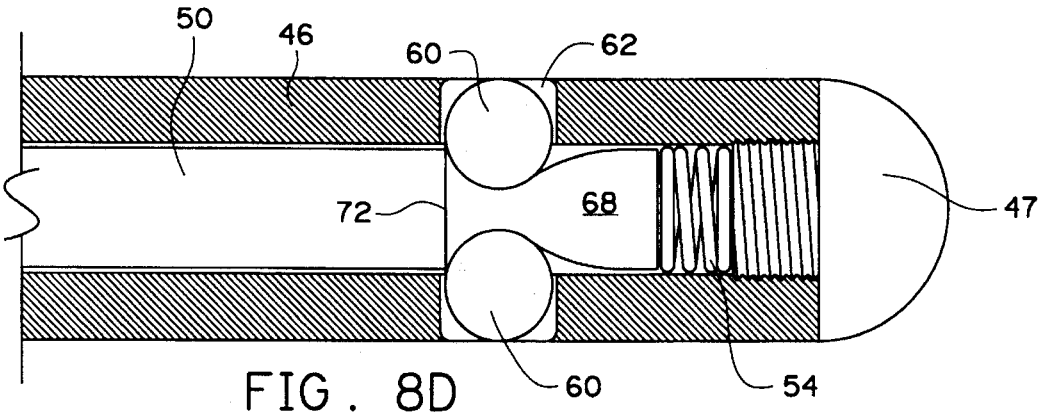

Angular adjustment means 49 further comprise lock-bearings 60, transverse lock-bearing bore 62 of track rod 46 and lock-bearing contact surface 66 of track receptacle 44. FIG. 8A shows a front partial cross-sectional view of an apparatus for attaching a light housing to a mask body or other structure, according to one preferred embodiment of this invention. FIG. 8B shows an enlarged front partial cross-sectional view of the portion of the apparatus shown in the dashed line box of FIG. 8A. FIGS. 8C and 8D show enlarged top partial cross-sectional views of lock-bearing rod 50 shown in FIG. 8B, in a locked and an unlocked position, respectively.

Preferably two lock-bearings 60 are positionable in two corresponding transverse lock-bearing bores 62, as clearly shown in FIGS. 8C and 8D. It is apparent that each lock-bearing bore 62 is preferably positioned transverse with respect to a longitudinal axis of track rod 46, but it is also apparent that each lock-bearing bore 62 can be disposed in other suitable positions with respect to track rod 46. Furthermore, lock-bearings 60 interfere with lock-bearing rod 50 when lock-bearing rod 50 is in a locked position, as shown in FIGS. 3, 4 and 8C. Lock-bearings 60 abut and thus interfere with contact surface 66 of track receptacle 44, as clearly shown in FIGS. 3 and 4. Accordingly, FIGS. 2A–2D, 3 and 4 show lock-bearings 60 abutting or interfering with contact surface 66 thereby prohibiting axial movement of track rod 46 within track bore 48.

Figure 5:
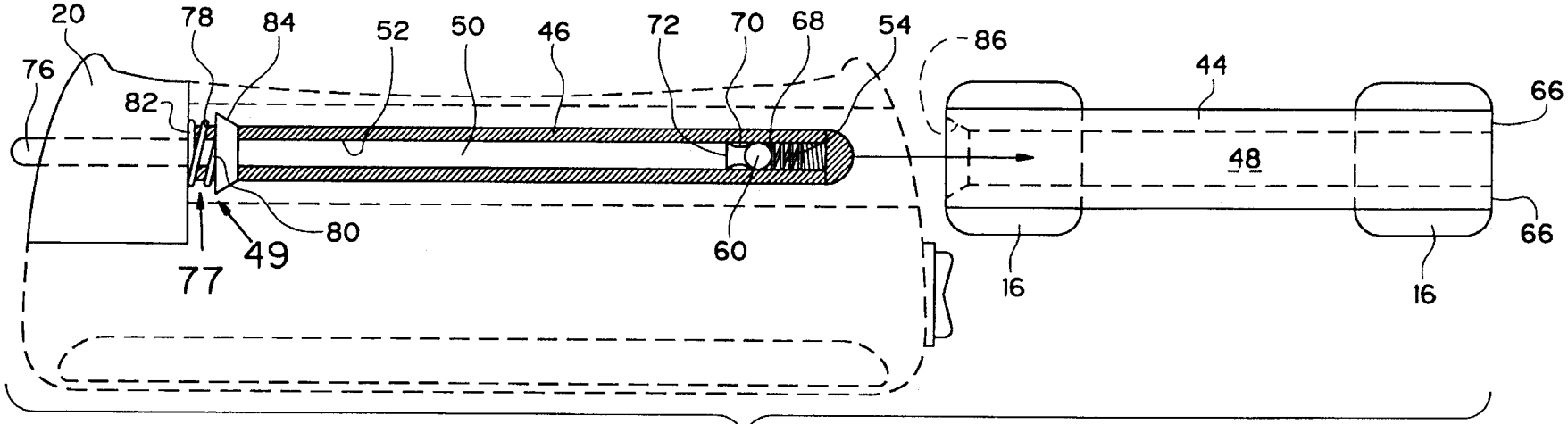
FIG. 5 is an exploded top partial cross-sectional view of an apparatus for attaching a light housing to a mask body or other structure, according to another preferred embodiment of this invention.

As shown in FIGS. 3–5 and 8B–8D, lock-bearing rod 50 comprises locking rod portion 68 and tapered rod portion 70 which is positioned adjacent locking rod portion 68. Tapered rod portion 70 converges or tapers in a direction toward lock-bearing rod 50 and in a direction away from locking rod portion 68. Although shown in FIGS. 3–5 and 8B–8D as a curved surface, it is apparent that the surface of tapered rod portion 70 can converge or taper to form a straight surface. In one preferred embodiment of this invention, lock-bearing stop 72 is formed at a shoulder edge of lock-bearing rod 50, which is positioned adjacent tapered rod portion 70. Thus, in a locked position, as shown in FIGS. 2A–2D, 3–5 and 8C, lock-bearings 60 abut locking rod portion 68, are positioned partially within transverse lock-bearing bore 62, and project beyond an outer surface of track rod 46 far enough to interfere with contact surface 66 of track receptacle 44, when in the locked position. As shown in FIGS. 3–5, release button end 76 of lock-bearing rod 50 extends beyond longitudinal track rod bore 52. As shown in FIG. 6, housing rod end 74 of track rod 46 is attached to light housing 20. In an unlocked position of lock-bearing rod 50, release button end 76 can be depressed to cause lock-bearing rod 50 to move towards and compress return spring 54. During such relative motion, lock-bearings 60 follow a surface of tapered rod portion 70, thereby causing lock-bearings 60 to recede Within transverse lock-bearing bores 62, below the outer surface of track rod 46. The lock-bearing rod 50 and lock-bearing 60 arrangement of this invention allows for quick release and removal of light housing 20 from track receptacle 44.

As shown in FIGS. 3–6, angular adjustment means 49 further comprise track receptacle bias means 77 for urging track rod 46 into a locked angular position with respect to track receptacle 44. According to one preferred embodiment of this invention, track receptacle bias means 77 comprise compression spring 78 surrounding track rod 46, whereby track receptacle end 80 of compression spring 78 is fixed with respect to or abuts beveled washer 84. Housing end 82 of compression spring 78 is fixed with respect to or abuts light housing 20. Angular adjustment means 49 may further comprise beveled washer 84 mounted on track rod 46 and as shown in FIG. 5, beveled contact surface 86 of track receptacle 44. As shown in FIGS. 3 and 4, beveled washer 84 contacts beveled contact surface 86, and in an assembled and locked position of lock-bearing rod 50, compression spring 78 is compressed between light housing 20 and beveled washer 84, thereby providing frictional resistance between beveled washer 84 and beveled contact surface 86. Preferably, enough of such frictional resistance is caused by compression spring 78 to rotationally secure light housing 20 in a fixed or desired angular position.

As shown in FIG. 1, light housing 20 may comprise a plurality of light source compartments 88, with at least one light source 90 positioned within each light source compartment 88. Furthermore, each light source compartment 88 may be independently sealed. Sealing each light source compartment 88 independently assures that if one light source compartment 88 fills with water, for example, the other light source 90 will not electrically short out.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. In an apparatus for attaching light means to a mask body, the improvement comprising:

a clamp body, clamping means for fixing a relative position of said clamp body with respect to the mask body;

a light housing, and pivot means for rotatably adjusting and fixing said light housing at a desired angle with respect to said clamp body, said pivot means comprising a track rod fixed with respect to the mask body; and angular adjustment means for adjustably rotating and fixing an angular position of said track rod with respect to the mask body, said angular adjustment means comprising a lock-bearing rod, said track rod having a longitudinal track rod bore, said lock-bearing rod slidably mounted within said longitudinal track rod bore, and rod bias means for urging said lock-bearing rod into a normally locked position with respect to said track rod.

2. In an apparatus according to claim 1, wherein said clamping means comprise a moveable clap bracket, and clamp adjustment means for adjustably moving and then fixing a position of said moveable clamp bracket with respect to said clamp body.

3. In an apparatus according to claim 2, wherein said clamp adjustment means comprise said moveable clamp bracket having an internally threaded bore, an externally threaded clamp adjustment screw rotatably mounted with respect to said clamp body, and said externally threaded clamp adjustment screw engageable within said internally threaded bore.

4. In an apparatus according to claim 3, wherein said internally threaded bore of said moveable clamp bracket is a through bore.

5. In an apparatus according to claim 3, wherein said externally threaded clamp adjustment screw has a bearing end, said stationary clamp bracket has a bearing end support bore, and said bearing end is positioned within said bearing end support bore.

6. In an apparatus according to claim 1, wherein said track rod is cylindrical.

7. In an apparatus according to claim 1, wherein said angular adjustment means further comprise track receptacle bias means for urging said track rod into a locked angular position with respect to said track receptacle.

8. In an apparatus according to claim 7, wherein said track receptacle bias means comprise a compression spring surrounding said track rod, a track receptacle end of said compression spring fixed with respect to said track receptacle, and a housing end of said compression spring fixed with respect to said track rod.

9. In an apparatus according to claim 8, wherein said angular adjustment means further comprise a beveled washer, said track receptacle having a beveled contact surface, said beveled washer contacting said beveled contact surface.

10. In an apparatus according to claim 1, wherein said light housing comprises a plurality of light source compartments, a light source positioned within each of said light source compartments, and each of said light source compartments being independently sealed.

11. In an apparatus for attaching light means to a mask body, the improvement comprising:

a clamp body, a moveable clamp bracket, said moveable clamp bracket having an internally threaded bore, an externally threaded clamp adjustment screw rotatably mounted with respect to said clamp body, and said externally threaded clamp adjustment screw engageable within said internally threaded bore, an adjustment screw support bracket fixed with respect to said clamp body, said adjustment screw support bracket having an internally threaded bracket through bore, and said externally threaded clamp adjustment screw threadedly engaged within said internally threaded bracket through bore; and a light housing, and pivot means for rotatably adjusting and fixing said light housing at a desired angle with respect to said clamp body.

12. In an apparatus for attaching light means to a mask body, the improvement comprising:

a clamp body, a moveable clamp bracket, a stationary clamp bracket fixed with respect to said clamp body, clamp adjustment means for adjustably moving and then fixing a position of said moveable clamp bracket with respect to said clamp body, said stationary clamp bracket having a guide channel and said moveable clamp bracket having a support flange, and said support flange being slidably engaged within said guide channel.

13. In an apparatus for attaching light means to a mask body, the improvement comprising:

a clamp body, clamping means for fixing a relative position of said clamp body with respect to the mask body; and a light housing, a track receptacle, said track receptacle fixed with respect to said clamp body, a track rod, said track rod fixed with respect to said light housing, said track receptacle having a track bore, said track rod rotatably mountable within said track bore;

a lock-bearing rod, said track rod having a longitudinal track rod bore, said lock-bearing rod slidably mounted within said longitudinal track rod bore, and rod bias means for urging said lock-bearing rod into a normally locked position with respect to said track rod.

14. In an apparatus according to claim 13, wherein said rod bias means comprise a return spring positioned within said longitudinal track rod bore and biasing said lock-bearing rod into said normally locked position.

15. In an apparatus according to claim 14, wherein a track rod end of said return spring is fixed with respect to said track rod, and a lock-rod end of said return spring is fixed with respect to said lock-bearing rod.

16. In an apparatus according to claim 13, wherein said angular adjustment means further comprise a lock-bearing, said track rod having a transverse lock-bearing bore, said lock-bearing positionable in said transverse lock-bearing bore, said lock bearing abutting said lock-bearing rod, and in said normally locked position said lock bearing abutting a contact surface of said track receptacle.

17. In an apparatus according to claim 16, wherein said lock-bearing rod comprises a locking rod portion, a tapered rod portion adjacent said locking rod portion, said tapered rod portion converging in a direction away from said locking rod portion, and a lock-bearing stop adjacent said tapered rod portion.

18. In an apparatus according to claim 13, wherein a housing rod end of said track rod is attached to said light housing, and a release end of said lock-bearing rod extends beyond said longitudinal track rod bore.

19. In an apparatus for attaching light means to a mask body, the improvement comprising:

a clamp body, a stationary clamp bracket attached with respect to said clamp body, a moveable clamp bracket having an internally threaded bore, an externally threaded clamp adjustment screw rotatably mounted with respect to said clamp body, said externally threaded clamp adjustment screw threadedly engageable with said internally threaded bore, a track receptacle, said clamp body fixed with respect to said track receptacle;

a track rod, a light housing, said track rod fixed with respect to said light housing, said track receptacle having a track bore, said track rod rotatably mountable within said track bore;

a lock-bearing rod, said track rod having a longitudinal track rod bore, said lock-bearing rod slidably mounted within said longitudinal track rod bore, a return spring, said return spring positioned within said track bore, said return spring urging said lock-bearing rod into a normally locked position with respect to said track rod, a lock bearing, said track rod having a transverse lock-bearing bore, said lock bearing positionable in said transverse lock-bearing bore, said lock bearing abutting said lock-bearing rod, in said normally locked position said lock bearing abutting a contact surface of said track receptacle, and a compression spring, a track receptacle end of said compression spring fixed with respect to said track receptacle and a housing end of said compression spring fixed with respect to said track rod.

20. In an apparatus for rotatably mounting a housing to a structural body, the improvement comprising:

pivot means for rotatably adjusting and fixing the housing at a desired angle with respect to the structural body, said pivot means comprising a track receptacle fixed with respect to the structural body, a track rod fixed with respect to the housing, said track receptacle having a track bore, said track rod rotatably mountable within said track bore; and angular adjustment means for adjustably rotating and fixing an angular position of said track rod with respect to said track receptacle, said angular adjustment means comprising a lock-bearing rod, said track rod having a longitudinal track rod bore, said lock-bearing rod slidably mounted within said longitudinal track rod bore, a washer mounted on said track rod, and receptacle bias means for urging said washer into frictional contact with respect to said track receptacle; and rod bias means for urging said lock-bearing rod into a normally locked position with respect to said track rod.

* * * * *